United States Patent [19]

Patrician et al.

[11] Patent Number: 4,670,216

[45] Date of Patent: Jun. 2, 1987

[54] PROCESS FOR PRODUCING MOLYBDENUM AND TUNGSTEN ALLOYS CONTAINING METAL CARBIDES

[75] Inventors: Thomas J. Patrician, Monroeton; Vito P. Sylvester, Athens; Harry D. Martin, III, Troy, all of Pa.

[73] Assignee: GTE Products Corporation, Stamford, Conn.

[21] Appl. No.: 911,602

[22] Filed: Sep. 25, 1986

[51] Int. Cl.[4] ..... B22F 1/00

[52] U.S. Cl. ..... 419/15; 419/14; 419/17; 419/54; 419/57; 419/58; 419/59; 419/60; 75/245; 75/248

[58] Field of Search ..... 419/14, 15, 17, 54, 419/57, 58, 59, 60; 75/245, 248

[56] References Cited

U.S. PATENT DOCUMENTS

| | | | |
|---|---|---|---|
| 2,509,838 | 5/1950 | Oswald | 419/54 |
| 2,793,116 | 5/1957 | Cuthbert et al. | 419/54 |
| 4,108,650 | 8/1978 | Fustier et al. | 419/54 |
| 4,225,344 | 9/1980 | Fujimori et al. | 419/54 |
| 4,605,599 | 8/1986 | Penrice et al. | 419/54 |
| 4,612,162 | 9/1986 | Morgan et al. | 419/54 |

*Primary Examiner*—Stephen J. Lechert, Jr.
*Attorney, Agent, or Firm*—Donald R. Castle

[57] ABSTRACT

A three step process in which a metal alloy selected from a tungsten based alloy and molybdenum based alloys is provided to prevent the decarbonization of the alloys. The process involves a three step sintering process wherein the atmosphere during the initial heating step is a mixture of carbon monoxide and hydrogen, thereafter at a intermediate temperature range the atmosphere is hydrogen and a final heating step at a elevated temperature is employed and the atmosphere is a mixture of inert gas and a source of carbon.

7 Claims, No Drawings

PROCESS FOR PRODUCING MOLYBDENUM AND TUNGSTEN ALLOYS CONTAINING METAL CARBIDES

FIELD OF THE INVENTION

This invention relates to the production of molybdenum and tungsten alloys containing metal carbides. More particularly it relates to the process for producing such alloys from powdered metals under conditions which prevent decarburization of the alloys.

BACKGROUND OF THE INVENTION

Tungsten and molybdenum based alloys containing carbon that are sintered under hydrogen undergo decarburization through methane formation. Additionally, if oxygen is present, stable oxides are formed by the oxidation of the alloying elements that are normally present such as titanium, zirconium and hafnium. Stable oxides are formed during sintering because oxygen replaces the carbon in the carbides. This lessens the strengthening power of the alloy system. It is believed therefore that the method of preventing decarburization and eliminating the oxygen available for the formation of stable oxides from the alloying elements would be an advancement in the arts.

SUMMARY OF THE INVENTION

In one aspect of this invention a process is provided which comprises filling a mold with a metal alloy powder wherein the alloy is selected from the group consisting of tungsten based alloys and molybdenum based alloys and wherein the powder contains less than about 150 ppm of oxygen. The powder is pressed to form a billet thereafter the billet is heated from ambient to a first temperature in a first atmosphere consisting essentially from about 10% to about 20% by volume of carbon monoxide, balance hydrogen and maintaining the billet in the first atmophere and at the first temperature for a predetermined period. The temperature of said billet is then increased to a second temperature in a second atmosphere consisting essentially of hydrogen. The second temperature is from about 1300° C. to about 1500° C. The billet is maintained at the second temperature for at least about 120 minutes. The temperature is then increased to a third temperature in a third atmosphere in which the third atmosphere consists essentially of inert gas and a source of carbon. The third temperature is from about 1500° C. to about 2000° C. The billet is maintained in said third atmosphere and at said third temperature for at least about 10 hours and thereafter cooled to at least about 1500° C. in the third atmosphere. The third atmosphere can be an inert gas (Ar, e.g.) or a partial vacuum containing a source of carbon which can be a block of graphite or a partial pressure of methane.

DETAILS OF THE PREFERRED EMBODIMENT

For a better understanding of the present invention, together with other and further objects, advantages, and capabilities thereof, reference is made to the following disclosure and appended claims in connection with the foregoing description of some of the aspects of the invention.

As is previously mentioned the reaction thought to be responsible for the decarburization phenomenon was that hydrogen reacted with carbon to form methane. Heretofore it was believed that if the sintering atmosphere did not contain hydrogen no decarburization would occur, that is, sintering in a vacuum or inert atmosphere like argon or helium would eliminate decarburization. It has been found, however, that the decarburization of these alloys also occurs by a carbon monoxide decarburization reaction when the oxygen in the alloy system reacts with the carbides in the system to form carbon monoxide.

Thus two kinds of decarburization reactions have been found to occur in the hydrogen sintering of molybdenum alloys containing carbides, tungsten alloys containing carbides or molybdenum-tungsten alloys containing carbides. The first is a formation of methane when hydrogen reacts with carbon and that occurs at temperatures above about 1500° C. The second is the formation of carbon monoxide when oxygen in the powder reacts with carbon at about the same temperature, that is about 1500° C. The oxygen also reacts with hafnium, zirconium and to a lesser degree with titanium to form very stable oxides. The oxides can not be broken down after their formation. The carbon monoxide reaction could possible be eliminated by removing oxygen from the powder or by using a hydrogen-carbon monoxide mixed atmosphere. The carbon monoxide-hydrogen mixed atmosphere is undesirable because the carbon monoxide reacts with the alloying elements to form stable oxides at temperatures above 800° C. The methane formation can be suppressed by using hydrogen and methane but this type of atmosphere increases the carbon content of the system to undesirable high levels of high temperatures.

In the process of this invention, decarburization is reduced and the stable oxide formation is held to a minimum by providing a metal alloy powder containing less than 150 ppm of oxygen. The low oxygen content material is pressed to form a green part which is thereafter subjected to a step under non-oxidizing condition to form a billet. The billet is then subjected to sintering at a temperature of up to about 700° C. using an atmosphere of from about 10% to about 20% carbon monoxide balance hydrogen. After reaching the temperature range of from about 500° to about 700° C., more preferably 550° C., the material is held at that temperature for about 0.5 hours to about 4 hours, preferably about 1 hour. Thereafter, the atmosphere is changed to hydrogen and is heated from about 550° C. to a second temperature range which is about 1300° C. to about 1600° C. with about 1500° C. being preferred. The material of the billet is held at the second temperature for at least about 2 hours to about 20 hours with twelve hours being preferred. Thereafter the material is raised to a third temperature and a third atmosphere of an inert gas such as argon and a carbon potential is used in the third atmosphere. The third temperature range is about 1700° C. to about 2300° C. with about 2100° C. being the optimum. The carbon potential can be provided by a block of graphite which will evolve carbon at the sintering temperature or it can be provided by a methane partial pressure in a vacuum with total pressure of about $10^{-5}$ Torr.

While there has been shown and described what are considered the preferred embodiments of the invention, it will be obvious to those skilled in the art that various changes and modifications may be made therein without departing from the scope of the invention as defined by the appended claims.

What is claimed is:

1. A process comprising (a) filling a mold with an admixture consisting essentially of a metal alloy powder wherein the alloy is selected from the group consisting of tungsten based alloys and molybdenum based alloys wherein the powder contains less than about 150 parts per million of oxygen, (b) pressing said admixture to form a green part, (c) heating said billet from ambient temperature to a first temperature in a first atmosphere consisting essentially of about 10% to about 20% by volume of carbon monoxide, balance hydrogen, said first temperature being from about 500° C. to about 700° C., maintaining said billet in said first atmosphere at said first temperature for at least about 30 minutes, (d) increasing the temperature of said billet to a second temperature in a second atmosphere consisting essentially of hydrogen, said second temperature being from about 1300° C. to about 1600° C., (e) maintaining said billet in said second atmosphere for at least about 120 minutes, (f) increasing the temperature of said billet to a third temperature in a third atmosphere consisting essentially of an inert gas and a source of carbon wherein said third temperature is from about 1700° C. to about 2300° C.

(g) maintaining said billet in said third atmosphere at said third temperature for at least about 6 hours, and (h) cooling to at least about 1600° C. in said third atmosphere.

2. A process according to claim 1 wherein said temperature is about 550° C.

3. A process according to claim 2 wherein said second temperature is about 1500° C.

4. A process according to claim 3 wherein said third temperature is about 2100° C.

5. A process according to claim 4 wherein said inert gas is argon.

6. A process according to claim 5 wherein said source of carbon is a block of graphite.

7. A process according to claim 6 wherein said billet is heated at said third temperature in a third atmosphere wherein the source of carbon is a methane partial pressure in a vacuum is maintained sufficient to provide a source of carbon from said methane.

* * * * *